United States Patent [19]

Lindstadt et al.

[11] Patent Number: 4,860,658

[45] Date of Patent: Aug. 29, 1989

[54] REMOTE ACTION MINE

[75] Inventors: Klaus Lindstadt, Schwaig; Detlev Wittmer, Lauf, both of Fed. Rep. of Germany

[73] Assignee: Diehl GmbH & Co., Nurnberg, Fed. Rep. of Germany

[21] Appl. No.: 171,961

[22] Filed: Mar. 23, 1988

[30] Foreign Application Priority Data

Apr. 4, 1987 [DE] Fed. Rep. of Germany ..... 3711500

[51] Int. Cl.[4] ..... F42B 23/26; F42B 23/04

[52] U.S. Cl. ..... 102/427

[58] Field of Search ..... 102/427, 213, 214

[56] References Cited

U.S. PATENT DOCUMENTS 3,304,864 2/1967 Thomanek ..... 102/427

3,509,791 5/1970 Pechamak ..... 102/427

4,398,466 8/1983 Sepp et al. ..... 102/427

FOREIGN PATENT DOCUMENTS 2262366 3/1978 Fed. Rep. of Germany ..... 102/427

*Primary Examiner*—Charles T. Jordan

*Attorney, Agent, or Firm*—Scully, Scott, Murphy & Presser

[57] ABSTRACT

A remote action mine, particularly a projectile-launching anti-tank remote action mine which includes a sensor logic for the obtention of a firing signal. The mine is equipped with a range finder and with a memory storage for the initial and final values of at least one range of action which is dependent upon the distance of the axis of action of the mine, with the suppression of the delivery of firing signals for target distances which are located outside of the stored range of action.

6 Claims, 2 Drawing Sheets

REMOTE ACTION MINE

BACKGROUND OF THE INVENTION

1. Field of the Invention

The present invention relates to a remote action mine, and particularly to a projectile-launching anti-tank remote action mine which includes a sensor logic for the obtention of a firing signal.

2. Discussion of the Prior Art

A remote action mine of the type which is under consideration herein is known as the weapon system "PARM 1". Such a remote action mine is positioned offset towards one side from the location of action, in order to fire a projectile possessing an armor-rupturing warhead, when the target object which is to be attacked is acquired within the axis of action through the intermediary of a target detector. Proposals of a nature which are similar to the type under consideration herein for such kinds of projectile-launching anti-tank remote action mines, for the bridging over of the action distance, do not operate against the target object with a projectile for the delivery of the warhead (with a barb-forming hollow charge insert and a proximity fuze device), but operate with a stationary warhead, in that a projectile-forming insert is deformed by an explosive and is fired against the acquired target object.

It is common to such type of concepts for remote action mines, that their mission effectiveness or applicability depends to a considerable extent upon the impact or striking surface of the target object which is detected within the axis of action. Thus, for example, when a target object, especially an armored vehicle, travels through a depression in a terrain, and thereby has only the upper portion of its turret crossing the axis of action of the remote action mine, there must be counted upon a low effectiveness in the target or even with a miss. When because of the conditions of the terrain it should even be possible to permit a vehicle to cross below the axis of action and hereby to lift only a dummy target into the axis of action for causing the response of the sensors of the remote action mine target detector, this will resultingly cause the remote action mine to trigger and to free the strip of terrain which is to be controlled by this remote action mine from this threat.

SUMMARY OF THE INVENTION

Accordingly, in recognition of these conditions it is an object of the present invention to significantly improve upon the capability or mission effectiveness of the usual anti-tank remote action mines without any significant increase in the requirements for apparatus or the operational technology thereof.

The foregoing object is inventively achieved through a projectile-launching anti-tank remote action mine of the type under consideration herein in that the mine is equipped with a range finder and with a memory storage for the initial and final values of at least one range of action which is dependent upon the distance of the axis of action of the mine, with the suppression of the delivery of firing signals for target distances which are located outside of the stored range of action.

In accordance with the foregoing object, it is possible that at the location of the deployment of the remote action mine there can be considered the contour of the terrain, and to thereby limit the firing of the remote action mine to the occurrence of target objects in regions of the terrain in which a large impact or striking surface promises a high degree of effectiveness in the target. Hereby, within the framework of the target detector, the remote action mine besides a range finder, need merely be provided with a memory storage for the values of the measured distances in order to separate the range of action along the axis of action of the mine into ineffective regions and regions of action. Hereby, the regions of action are those areas of the terrain between, presently, an initial and a final distance, which with regard to the axis of action of the installed mine evidence such a rise, whereby a target object which crosses the axis of action at that location can be detected at the largest possible broadside. When a target object is to be detected at such ranges in distance which are located either in front of or behind a so defined range of action, then by means of the range memory there is blocked the emission of a firing signal itself when the target detector reports an acquisition of a target at a sufficient probability; so as not to employ this mine against a target with an apparently smaller striking surface, but to save the mine for a target object within a more expedient range of action.

BRIEF DESCRIPTION OF THE DRAWINGS

Additional alternatives and modifications, as well as further features and advantages of the invention may now be readily ascertained from the following detailed description of an exemplary embodiment of the invention illustrated in a substantially schematic representation, taken in conjunction with the accompanying drawings; in which.

DETAILED DESCRIPTION

Figure 1:
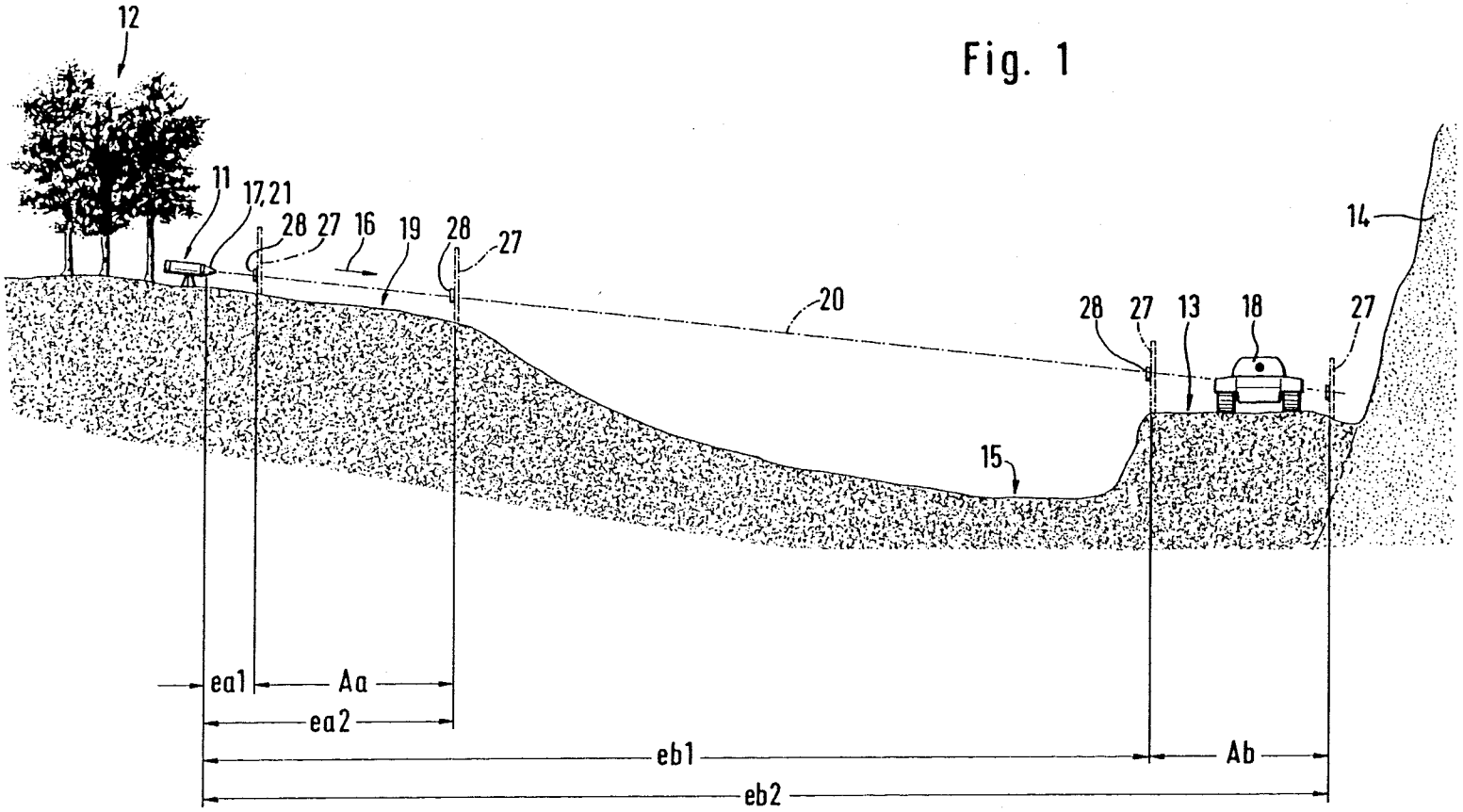
FIG. 1 illustrates a longitudinal section view through a terrain showing the typical case of deployment of an inventively equipped remote action mine.

The typical instance of utilization of the illustrated remote action mine 11 serves for the blocking of defined strips of terrain, such as mountain passes, bridges, roadways used in particular by heavy-armored vehicles or mine-blocked passages of intermediate range. In the scenario illustrated in FIG. 1, a remote action mine 11 is installed camouflaged in a wood 12 towards one side of a roadway 13 which runs between a mountain wall 14 and a depression 15 in the terrain. The direction of effect 16 of the warhead 17 of the mine is oriented in such a manner that a target object 18 which utilizes the roadway 13 is most possibly detected along its entire broadside; in effect, at a large striking surface across the roadway 13, and can be attacked. Resulting therefrom is that there can be attained expedient attacking conditions when the target object 18 is located within regions of action A which, in the illustrated scenario, across the width of the roadway 13 and across a strip of terrain 19, cross at a certain minimum function distance e in front of the remote action mine 11 through its axis of action 20. When, in contrast therewith, the target object 18 again crosses the axis of action 12 further offset towards the depression 15 in the terrain, then a detected broadside; in essence, the available striking surface becomes increasingly smaller, and thereby the degree of effectiveness in the utilization of the remote action mine 11 is lower. This type of remote action mine can even be rendered harmless without any relative danger, being encounted when for the purpose of initiating an erroneous firing, a vehicle travels in a protected state within the depression 15 in parallel with the roadway 13; inasmuch as only one target mock-up need be raised upwardly so as to intersect the axes of action 20 of remove action mines 11 which may be deployed offside, so as to lead to erroneous firings against dummy targets, as a result of which the roadway 13 can be subsequently safely used.

In order to preclude the foregoing, in the remote action mine 11 within the framework of its target detector 21, besides waking and triggering sensors 22 (which, for example, respond to ground tremors caused by heavier vehicle formations and to the heat radiation from the driving or propulsion aggregates of passing target objects 18), there is provided at least one range finder 23 which operates preferably active, in effect, in a reflector beam-position finding operation and, for example, can be designed as a laser range finder and, preferably, as a radar range finder. Moreover, a distance or range memory storage 24 is provided for the blending of range-dependent defineable action regions A in accordance with the extent of the topographic conditions along the axis 20. A sensor logic 25, in which the sensor signals which are delivered by the target detector 21 are analyzed and joined together, will then, and only then, deliver a trigger signal 26 for the firing of the warhead 17, when the target object 18 which is acquired by the sensor is not located outside one of the regions of action A defined in dependence upon the terrain; thus, when because of the larger striking surface of the target object 18 there can be counted upon a good degree of effectiveness in the utilization of the remote action mine 11.

The definition of the regions of action A, in the interest of a good correlation with the actual terrain conditions, is preferably carried out immediately after the positioning and orientation of the remote action of mine 11. For this purpose, there can be used, for example, in the geodesic science, a so-called cooperative target; in essence, an auxiliary aid which traverses the terrain along the axis of action 20 and which marks functionally-critical points on the terrain; namely, the respective beginning and the end of a usable region of action A in sequence by means of a range finding stadia or surveyor's rod 27 in sequence. Preferably, the measuring bar 27 is equipped with reflectors 28 optimized to the operating spectrum of the range finder 23 (tripod mirrors in the visible range, or corner reflectors in the millimeter-wave range of the electromagnetic radiation spectrum). In order to recognize the initial distance e1 and the final distance e2 of the applicable region of action A, there can be contemplated different reflector patterns or differently oriented polarizers in front of the reflectors 28, so that the applicable distance or range values e are obtained directly by the remote action mine range finder 23 and can be stored in the range memory 24 for the blending in of the intermediate regions between the regions of action A, in that the auxiliary aid will move the surveyor's rod or stadia 27 along the axis of action 20 across the terrain and always ensure the corresponding reflective orientation for the indication of the beginning or, respectively, the end of a region of action.

It can be simpler from the standpoint of apparatus and less susceptible to disturbances, that besides an auxiliary aid operation is effected with a setter which remains with the remote action mine 11, and a suitable signal of the auxiliary aid from the applicable distance e through an input field 29 on the remote action mine 11, triggers relative to the distance between the remote action mine 11 and the momentary position of the range finding stadia 27, and thereby transmits into the memory storage 24. For example, on the input field 29 there can be respectively actuated a pushbutton switch 30 for the measurement and transmission of an initial distance e1 and and an end distance e2, in dependence upon the momentary location of the range finding stadia 27, respectively, from the signal transmission of the servicing personnel. Hereby, provision can be made that, or example, in the instance of an error, the content of the range memory storage 24 can be erased for a new input, such as through simultaneous actuation of both pushbutton switches 30. Moreover, there can also be provided a memory control circuit 31 which, for example, takes care that because of corresponding range indications, erroneously overlapping regions or those which have been introduced only with functionally insignificant interspaces are stored for the armed function of the mine 11 as a continual region of action A.

Figure 2:
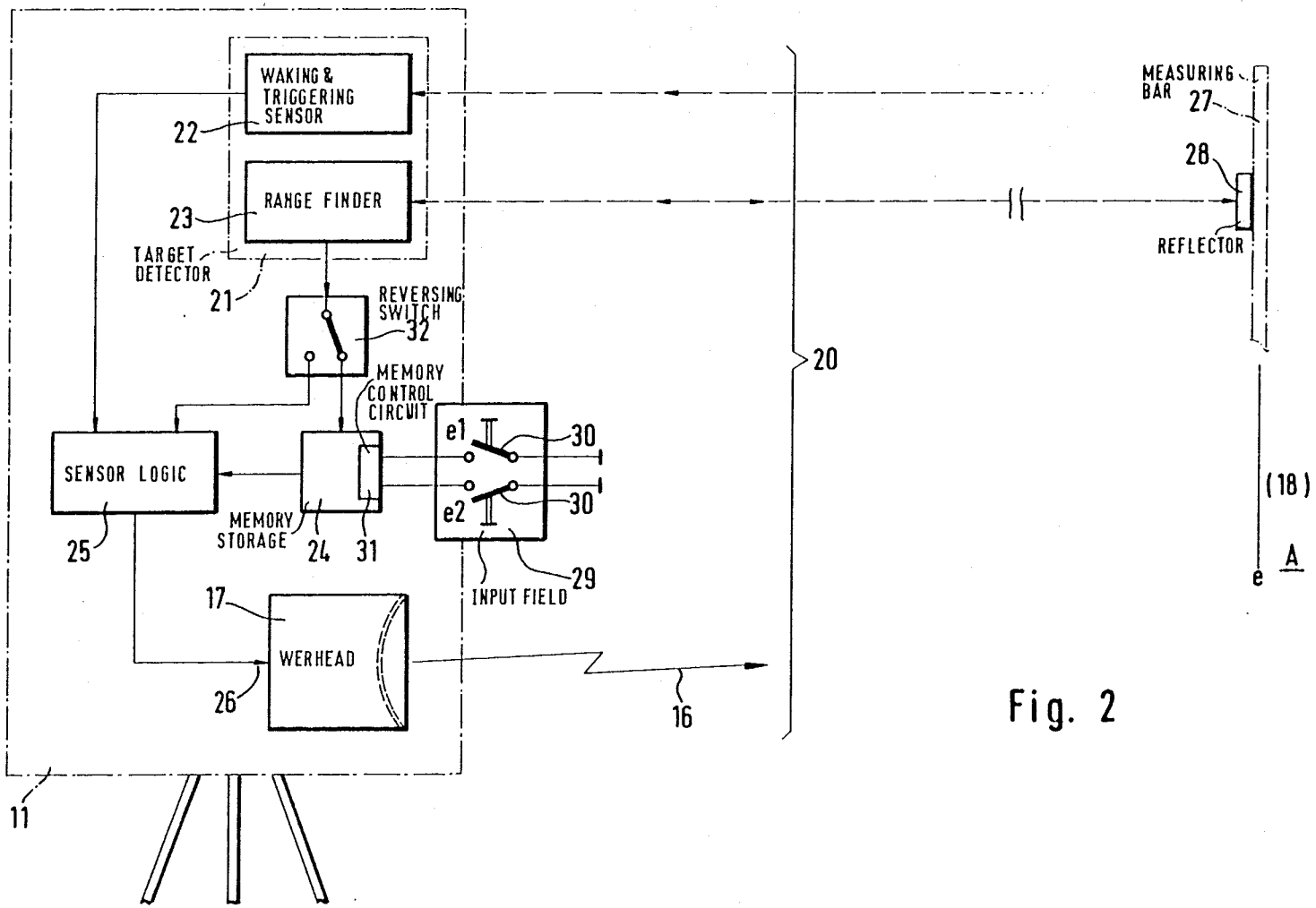
FIG. 2 illustrates the remote action mine with a distance or range discriminator shown in a single-pole block circuit diagram.

When the remote action mine 11 is thusly oriented and prepared and the servicing personnel has again returned from the terrain, an operational-type reversing switch 32 displaces from the heretofore-considered installation position (FIG. 2) into the armed position, wherein distances from a target object 18 determined by the range finder 23 are directly transmitted into the sensor logic 25 and are therein compared with the stored range informations for the definition of the regions of action A, in order to initiate the firing signal 26 only at a given distance to the target within a region of action A.

What is claimed is:

1. A projectile-launching anti-tank remote action mine, including a sensor logic for the obtention of a firing signal, comprising a range finder; and a memory storage for the initial and final value of each of a series of regions of action within an overall region containing regions of action and regions of ineffectiveness interposed between said regions of action in dependence upon the range along the axis of action of the mine, with suppression of the emission of firing signals for target distances in between neighboring regions of action which are stored in said memory storage so as to inhibit the erroneous initiation of said mine against a dummy target within a region of ineffectiveness.

2. Remote action mine as claimed in claim 1, wherein said memory storage includes a control circuit for the processing of range values for the definition of regions of action.

3. Remote action mine as claimed in claim 1, wherein reflectors determine the beginning and end of a region of action along the axis of action of said mine.

4. Remote action mine as claimed in claim 3, wherein differing reflector patterns are provided for the beginning and end distances.

5. Remote action mine as claimed in claim 3, wherein reflective radiation in different polarization directions are provided for the beginning and end distances.

6. Remote action mine as claimed in claim 1, including an input field for the transmission of momentarily measured beginning and end distances to the memory storage.

* * * * *